United States Patent [19]

Germain et al.

[11] 4,067,583

[45] Jan. 10, 1978

[54] SEALING DEVICE WITH CLOSURE SYSTEM FOR COMPRESSOR

[75] Inventors: Roger Louis Elysée Germain, Maisons Lafitte; Claude Eugène Désiré Duquenne, La Garenne, both of France

[73] Assignee: Societe Nationale d'Etude et de Construction de Moteurs d'Aviation, Evry, France

[21] Appl. No.: 752,891

[22] Filed: Dec. 21, 1976

[30] Foreign Application Priority Data

Dec. 24, 1975 France ..... 75.40387

[51] Int. Cl.[2] ..... F16J 15/16

[52] U.S. Cl. ..... 277/27; 277/88; 277/96

[58] Field of Search ..... 277/88–91, 277/53, 3, 96.1, 27, 9.5

[56] References Cited

U.S. PATENT DOCUMENTS

| | | | |
|---|---|---|---|
| 1,876,520 | 9/1932 | Newkirk et al. | 277/88 X |
| 2,912,265 | 11/1959 | Brummer | 277/88 X |
| 3,527,464 | 9/1970 | Goldberg | 277/90 X |
| 3,931,976 | 1/1976 | Duquenne | 277/80 |

FOREIGN PATENT DOCUMENTS

| | | | |
|---|---|---|---|
| 475,326 | 11/1937 | United Kingdom | 277/90 |
| 716,409 | 10/1954 | United Kingdom | 277/96 |

*Primary Examiner*—Robert S. Ward, Jr.
*Attorney, Agent, or Firm*—Cameron, Kerkam, Sutton, Stowell & Stowell

[57] ABSTRACT

The device comprises a driving mechanism, disconnectable coupling means, a rotor in which is conveyed a toxic gas, and an annular seal clamped between stationary knife-edges on the rotor and movable knife-edges associated with a movable annular support unit. A closure control element consisting of an annular jack causes the annular support unit to move between an inactive position and an active position and conversely. A second control element consisting of a resilient washer applies a complementary force to the annular support unit under the action of withdrawal of the driving mechanism.

8 Claims, 5 Drawing Figures

SEALING DEVICE WITH CLOSURE SYSTEM FOR COMPRESSOR

This invention relates to a sealing device mounted within a rotary machine between a driving element and a driven element, said elements being connected together by separable coupling means. Among sealing devices of this type, the invention is more particularly applicable to those which are intended to be mounted between a driving motor and a vertical compressor for special gases such as toxic or hazardous gases.

The primary aim of the device is to permit disconnection of the driving element from the driven element while retaining leak-tightness between this latter and the surrounding medium. Within the field of application which is more especially contemplated, it consequently becomes possible to uncouple the driving motor, for example in order to carry out general inspection, maintenance or repair work, while maintaining leak-tightness between the compressor and the surrounding atmosphere. This avoids the need to empty or to drain the compressor, the internal volume of which can thus remain occupied by the toxic or hazardous gas.

One well-known design of a sealing device with closure system for achieving leak-tightness of the compressor as mentioned above is constituted by an annular seal located in a plane at right angles to the axis of rotation of the compressor, said seal being clamped between on the one hand knife-edges formed for this purpose on the rotor of the compressor and on the other hand movable knife-edges associated with an annular support member which is capable of moving in the direction of the axis of the machine under the action of control means between an active position in which the support is urged towards the rotor and clamps the seal and an inactive position in which said support remains separated from this latter. In a solution of this type, however, the closure control results solely from an action performed externally of the machine and this does not offer a sufficient degree of safety in the field of application under consideration.

The aim of the present invention is therefore to offer a greater degree of operational safety by providing means for controlling the sealing device and closure system such that the failure of this latter which may result from a non-controlled external action does not lead to total ineffectiveness.

A further aim of the invention is to provide a sealing device with closure system in which the effort exerted on the seal can be adjusted while retaining a minimum value of safety which is independent of the weight of the rotor.

A further object of the invention is to permit the achievement of closure in spite of accidental wear of the annular seal which may result from faulty operation when the rotor is in motion.

Yet another aim of the invention is to offer a high-degree of reliability by providing a simple system which is in no way liable to jam.

To this end, the sealing device with closure system in accordance with the invention essentially comprises two closure control means which are put into operation successively. The first control means effects the displacement of an annular support unit between an inactive position and an active position and conversely under action produced externally of the machine. The second control means exerts a complementary effort on the annular support unit under the action of withdrawal of the driving mechanism.

In accordance with a preferred arrangement of the invention, the first closure control means for effecting the displacement of the support unit is an annular jack and the second control means is constituted by a resilient washer which produces action directly on the support unit by bearing on the rotor.

In this preferred arrangement of the invention, the limitation of accidental wear of the annular seal is ensured by means of a reduction in permissible travel of the support unit.

Further properties of the device under consideration will be explained in greater detail hereinafter, reference being made to the following description and to the accompanying drawings in which a number of embodiments of said device are illustrated by way of example without any limitation being implied, and in which.

Figure 1:
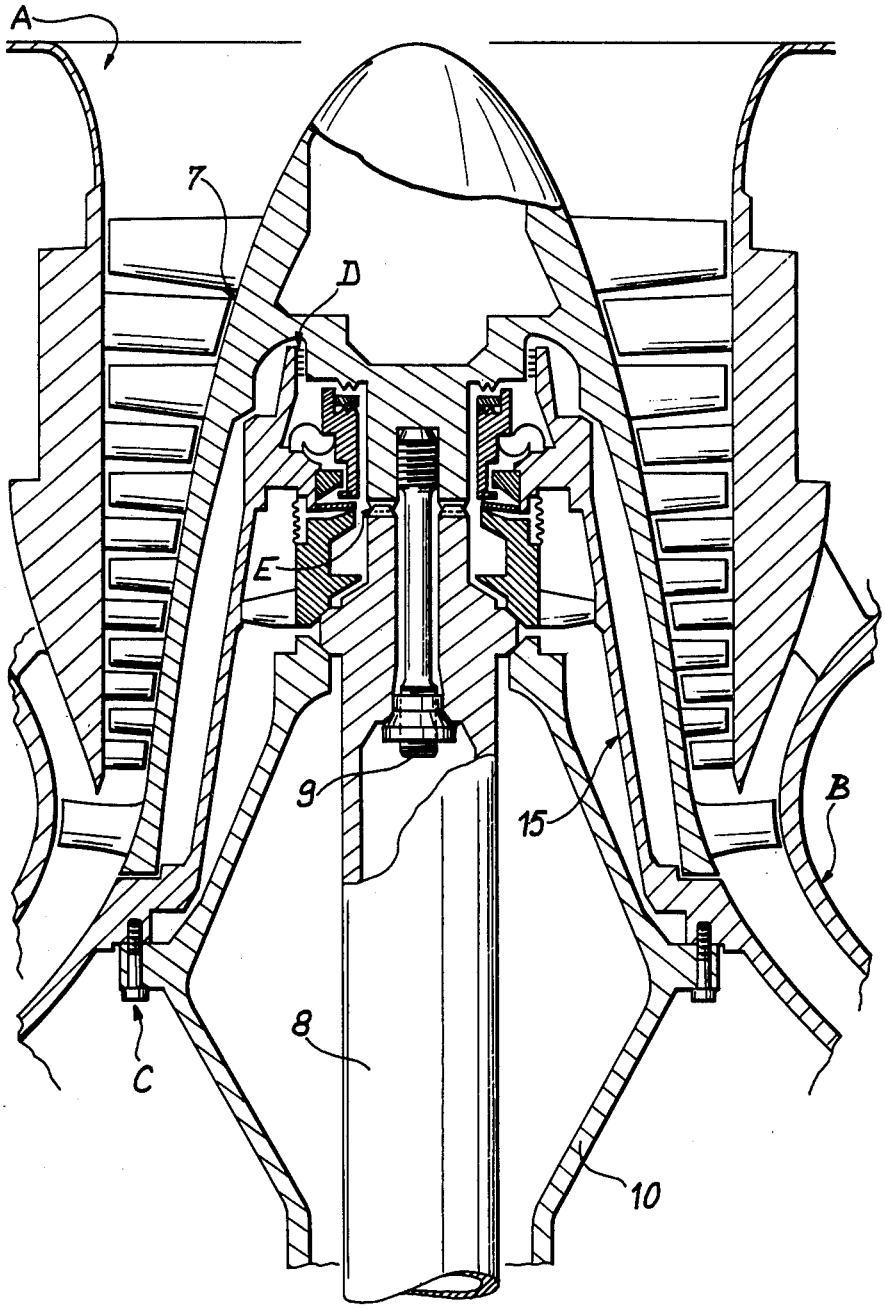
FIG. 1 is a partial diagrammatic view of a rotary machine equipped with a sealing device with closure system in accordance with the invention.

FIG. 1 illustrates a rotary machine A, especially a machine such as a centrifugal compressor having a vertical axis for a toxic or hazardous fluid. Said machine mainly comprises a rotor 7 mounted within a casing B which is in turn secured to a supporting frame 10 by means of screws C. A driving motor (not shown) is mounted beneath the compressor and drives a hollow shaft 8 rigidly fixed with respect to the rotor 7 by means of an axial fixing stud 9. The movement of the shaft 8 is transmitted to the rotor 7 by means of dog-clutch teeth E which cooperate with each other on these two portions of the machine. At the upper portion which surrounds the shaft 8, the frame 10 has an extension 15 for supporting a packing gland D which is applied against the rotor 7 but the efficiency of which is related to the speed of rotation of this latter. When the machine is stationary and especially when it is found necessary to separate the shaft 8 from the motor which drives the rotor 7, effective complementary leak-tightness must be achieved between the frame and the rotor at the level of this latter in order to prevent the toxic gas contained within the casing B from escaping to the external atmosphere after passing through the packing gland D.

Figure 2:
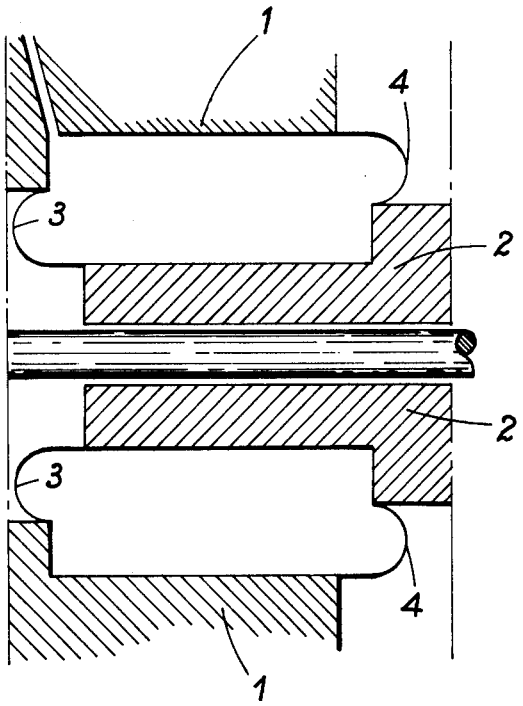
FIG. 2 is a diagrammatic sectional view to a larger scale showing the annular jack of the first control means.

FIG. 2 illustrates diagrammatically an annular jack provided with diaphragms and employed in the device in accordance with the invention. Said jack comprises a cylindrical body 1 and a hollow piston 2 in concentric relation. The cylindrical body 1 has two bores of different diameters which correspond respectively to two cylinders also having different diameters in the case of the hollow piston 2. These bores and cylinders form the walls of the jack so that each wall of the cylindrical body is joined to the corresponding wall of the hollow piston by means of semi-toric diaphragms 3 and 4 respectively, the concave portion of which is oriented towards the internal cavity of the jack. These semi-toric diaphragms are joined tangentialy to each of the respective walls.

The displacement of the piston 2 with respect to the jack body 1 results from the admission of a fluid under pressure into the cavity which is limited by the walls of the jack and by the two diaphragms 3 and 4. At the time of displacement of the piston 2, the two diaphragms run along the walls of the jack, thus producing a variaton in volume by reason of the difference in the mean diameters thereof which is added to the variation in volume resulting from the displacement of the piston. The diaphragms are attached to the walls of the jack, especially by welding, in order to ensure total containment of this latter.

Figure 3:
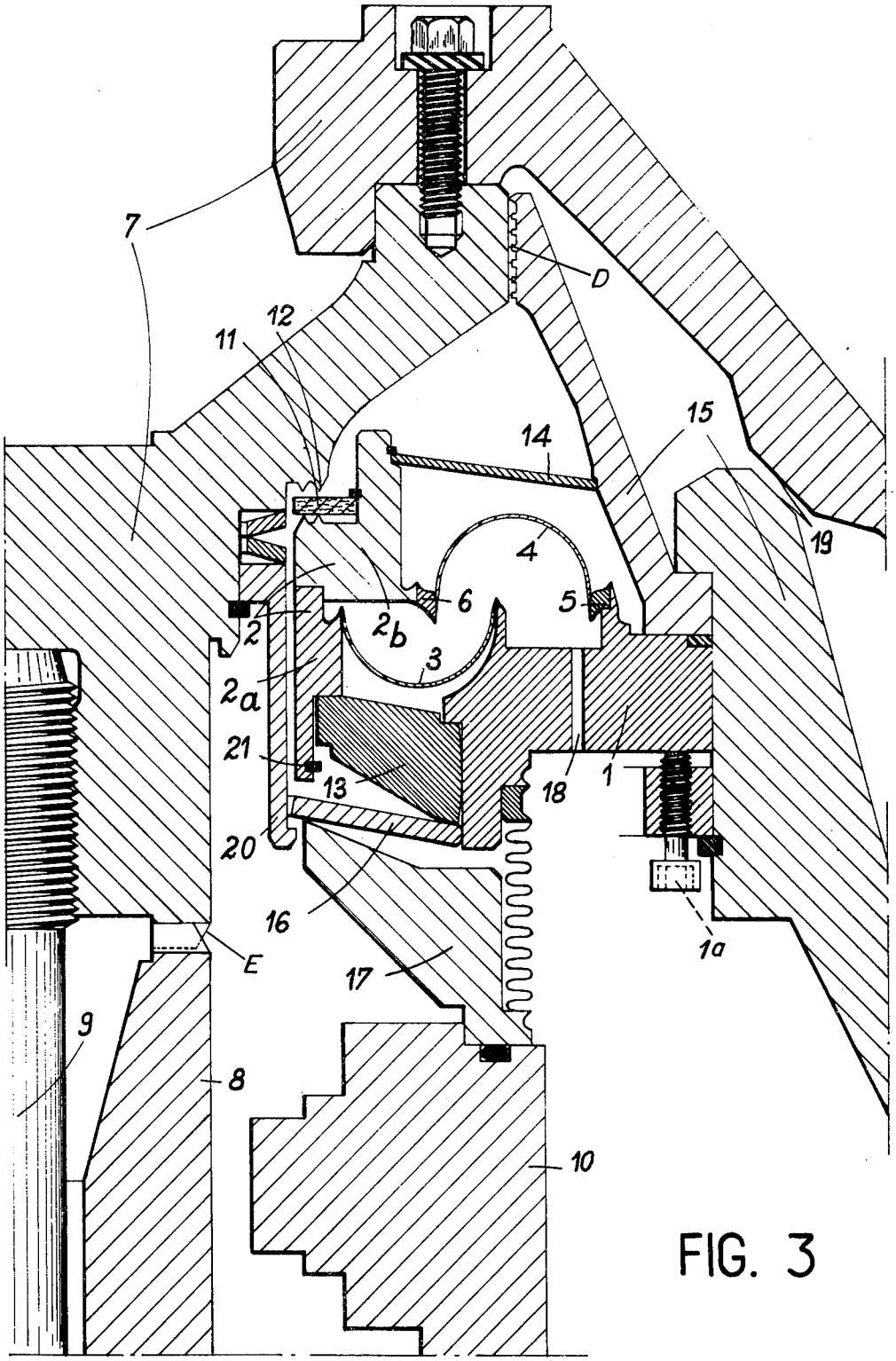
FIG. 3 is a sectional view of the sealing device with closure system in accordance with the invention as shown in the inactive position.
Figure 4:
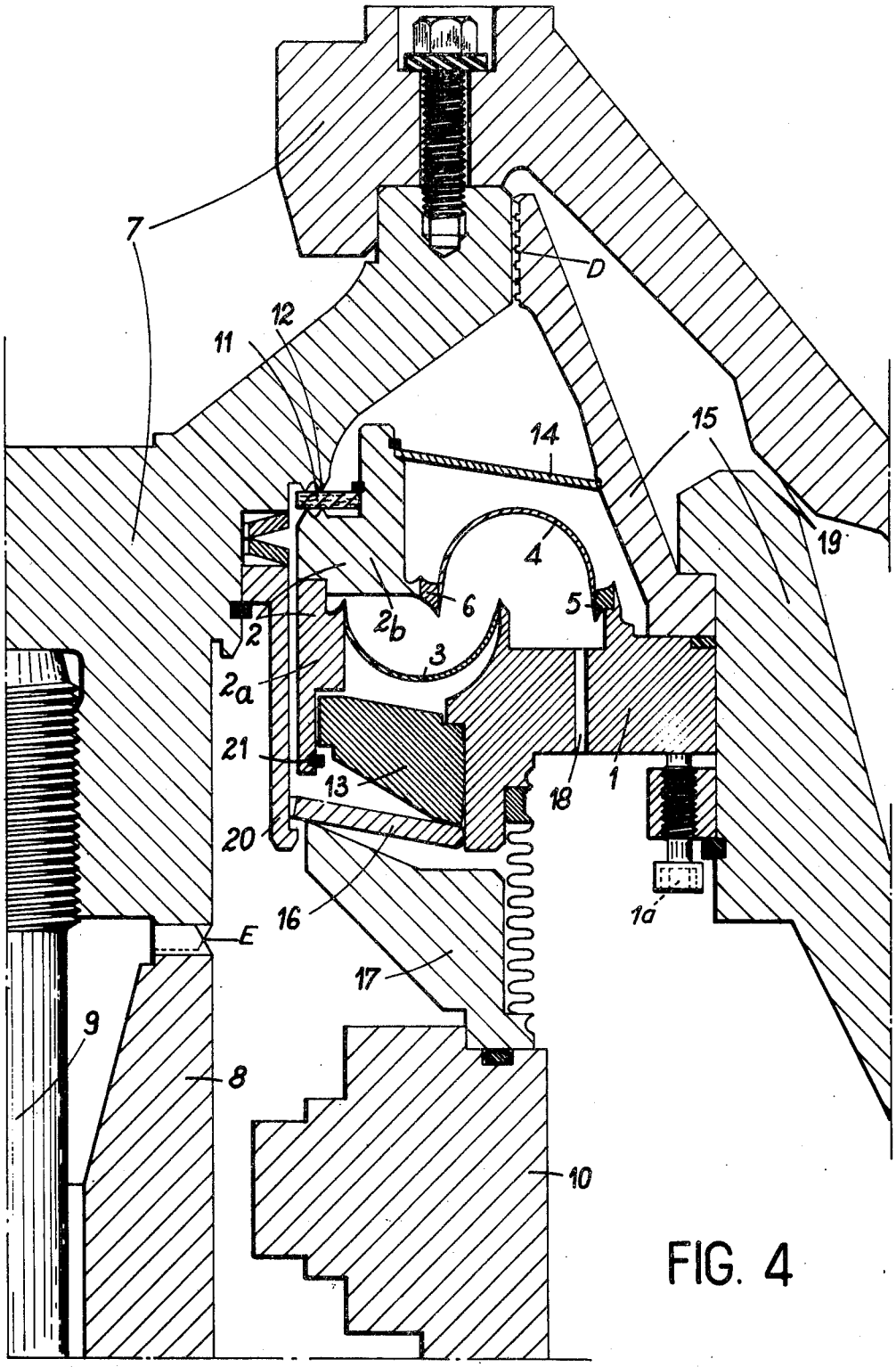
FIG. 4 illustrates the same device in the active position.
Figure 5:
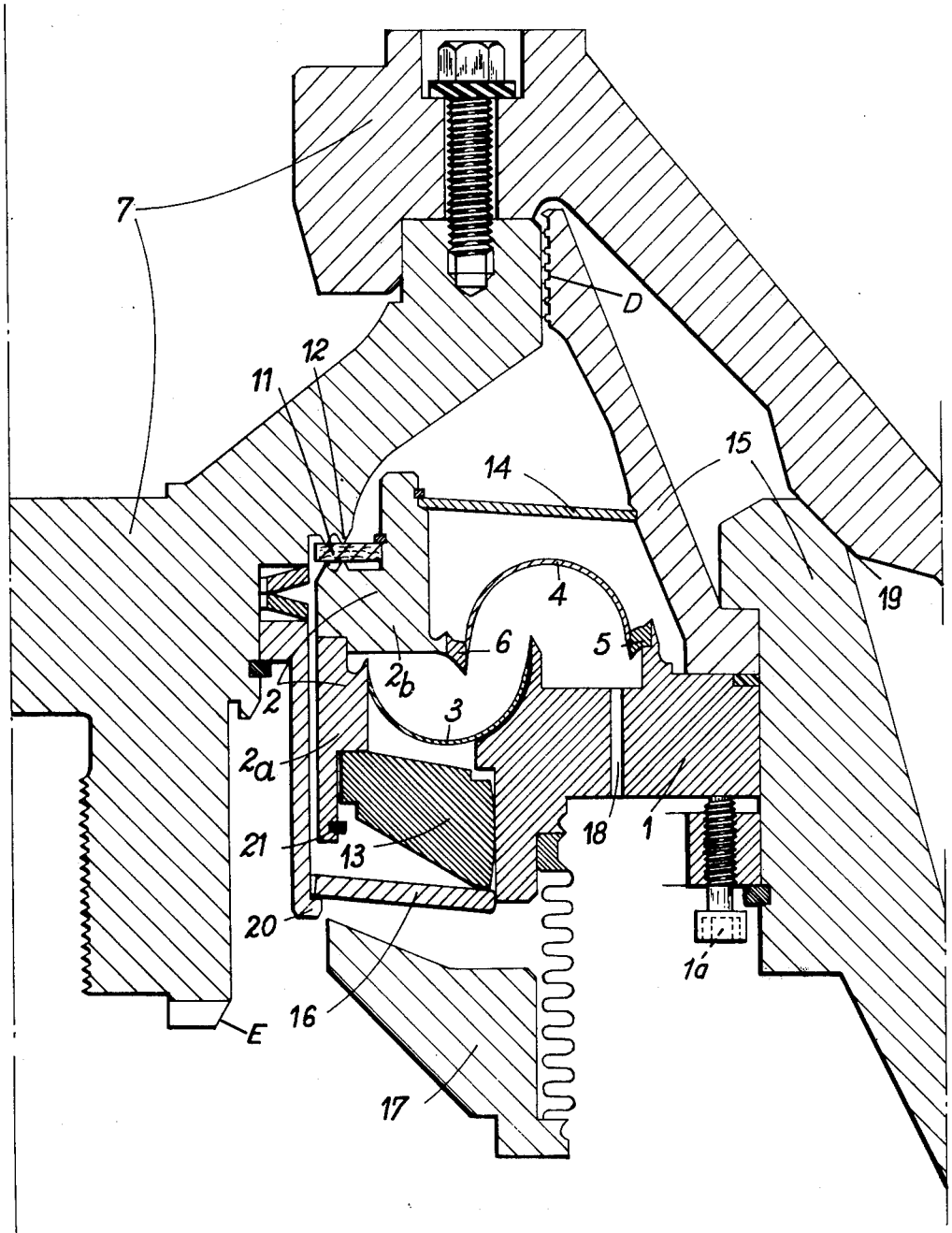
FIG. 5 is a sectional view of the device in which the driving mechanism is disconnected.

FIGS. 3, 4 and 5 illustrate a preferred embodiment of said annular jack. The body 1 of the jack is secured to the frame of the machine by means of screws 1*a*, for example. In this embodiment, the two diaphragms are metallic and are welded to the walls of the jack. The semi-toric shape of the diaphragms is favorable to the internal pressure which prevails within said jack, the welds being thus located in a zone of reduced stress.

The diaphragm 3 is welded directly to the jack body 1 and to a portion 2*a* of the piston 2. The diaphragm 4 is welded beforehand to two binding hoops 5 and 6 which are then welded respectively to the jack body 1 and to a portion 2*b* of the piston 2. The portions 2*a* and 2*b* of the piston 2 are also joined together by means of welds for example, the cavity formed by the walls of the jack and the diaphragms being thus leak-tight. The diaphragms 3 and 4 are mounted in such a manner as to subject the piston 2 to a continuous restoring force by virtue of their elasticity. Although the nature of said diaphragms in such as to limit the travel of the jack, this latter nevertheless remains sufficient for the operation which is desired.

As illustrated in FIGS. 3, 4 and 5, the jack piston 2 constitutes an annular support unit of the closure device. As shown in cross-section in FIGS. 3 and 4, this device is mounted between the driving motor and the compressor for toxic or hazardous gases, the motor being connected to the compressor by separable coupling means. As stated earlier, the motor is connected to the rotor of the compressor by means of splines or dog-clutch teeth E which are capable of disengagement simply as a result of axial displacement of the driving motor with respect to the rotor 7. Said rotor is maintained in rigidly fixed relation to the shaft 8 of the motor by means of the stud 9.

The sealing device with closure system in accordance with the invention comprises an annular seal 11 located in a plane at right angles to the axis of rotation of the compressor rotor 7. Said annular seal 11 is carried by the annular support unit 2 which is capable of axial displacement under the action of control means and in particular of the jack described earlier, between an active position in which said annular support member is urged towards knife-edges 12 formed on the rotor 7 and an inactive position in which said support member remains at a distance from said knife-edges.

The knife-edges 12 are advantageously constituted by circular grooves formed directly on the one hand on the rotor 7 and on the other hand on the annular support unit 2. Said knife-edges can also be formed on annular flanges which are either added to or fixed on the rotor and on the annular support unit. In all cases, said knife-edges serve to clamp the annular seal 11 under the action of the closure control means as produced in the first place by the jack, said control means being completed in accordance with the invention by a second control means which will be described below.

In the inactive position as illustrated in FIG. 3, the annular support unit 2 rests on a retaining ring 13. Said support unit 2 is maintained in this position by the restoring force exerted by the diaphragms 3 and 4. However, in a preferred embodiment of the invention, a resilient washer 14 serves to complete this restoring force and is applied on the one hand against the extension 15 of the frame of the machine and on the other hand against the annular support unit 2. The retaining ring 13 is maintained against the jack body 1 by means of another resilient washer 16, which provides an elastic seal between the casing 10 of the driving motor and the extension 15 by means of a ring 17.

In this position, the rotor 7 is capable of rotating and a leak-tight seal between the noxious fluid and the surrounding medium is ensured by the packing gland D.

FIG. 4 accordingly shows the device in the active position, that is, in the closed position of the closure system prior to disassembly. The fluid which is delivered under pressure into the annular jack by means of a duct 18 has the effect of displacing the support unit 2 and of bringing the seal 11 into contact with the knife-edges 12 provided on the rotor 7. The pressure within the jack is such as to counteract the restoring force applied to the annular support unit 2 on the one hand by the metallic diaphragms 3 and 4 and on the other hand by the resilient washer 14. Said pressure is adjusted so as to prevent damage to the annular seal 11 as a result of flattening by compression and to ensure total leak-tightness between the noxious fluid and the surrounding medium which may be at different pressures.

Control of the jack is carried out indifferently by means of either a pneumatic or a hydraulic system. In the case of a pneumatic control system, a compressor ensures sufficient pressurization of the jack through a valve (not shown). Said valve not only allows the fluid under pressure to pass from the compressor to the jack but also serves to connect said jack to free air. A safety device (also omitted from the drawings) is placed on said valve in order to ensure that pressurization of the jack can take place only after the rotor has come to a complete standstill.

In case of a hydraulic control system, a pump (not shown) driven by a motor delivers a liquid such as oil, for example, at values of output and pressure which are sufficient to displace the annular support unit 2. A valve provided with the same safety devices as in the case of a pneumatic control system is advantageously associated with this system.

The closure operation having thus been completed, the driving motor can be disconnected from the rotor 7. Thus the device with closure system is shown in cross-section in FIG. 5 when the driving motor has been separated from the rotor which is accordingly brought to bear on the frame of the machine. Withdrawal of the driving motor has resulted in a downward displacement of the rotor which is limited by the bearing track provided at 19. This displacement of the rotor is partially transmitted to the annular support unit 2 by means of the annular seal 11; said suport unit is applied against the retaining ring 13 and separates this latter from the jack body 1.

The displacement of the retaining ring 13 is counteracted by the resilient washer 16, said washer being applied against a stop-flange 20 which is integral with the rotor. The resilient washer 16 thus exerts a complementary effort on the annular seal 11 between on the one hand the knife-edges 12 of the rotor 7 and on the other hand the knife-edges of the annular support unit 2 while being applied against the rotor 7 by means of the stop-flange 20 and against the annular support unit 2 by means of the retaining ring 13.

The pressure within the jack can accordingly be released since the clamping effort is applied on the annular seal 11 solely by the resilient washer 16. Said washer 16 is therefore capable of overcoming the restoring force applied to the annular support unit 2 by the diaphragms 3 and 4 and the resilient washer 14, thus ensuring a constant force on the annular seal 11 independently of the weight of the rotor 7 while serving at the same time to lock the sealing device with closure system.

The operation of the device can readily be deduced from the foregoing: when the rotor 7 is stopped, a fluid and especially oil is delivered under pressured into the jack and displaces the annular support unit 2 and the seal 11 so as to put this latter contact with the knife-edges 12 of the rotor and to isolate the driving motor from the noxious fluid. The operation involved in disconnection of the rotor begins with the removal of the stud 9 which secures the motor shaft 8 to the rotor 7.

Withdrawal of the driving motor results in a limited downward displacement of the rotor 7, this displacement being transmitted to the annular support unit 2 by means of the seal 11 and to the retaining ring 13. Since the rotor is brought to bear on the frame of the machine at 19, only the driving motor can be displaced. The ring 17 which was held in position by the casing 10 of the motor in turn releases the resilient washer 16 which is maintained in a stationary position on the stop-flange 20.

The resilient washer 16 which is applied against the stop-flange 20 of the rotor 7 maintains the annular seal 11 in contact with the knife-edges 12 of the rotor by means of the annular support unit 2 and of the retaining ring 13. The pressure within the jack can then be released whilst closure is maintained by the resilient washer 16. The reverse operation clearly makes it possible to re-mount the driving motor.

The closure device in accordance with the invention also operates in the event of faulty operations resulting in accidental wear of the seal since wear of this kind is not intended to constitute an obstacle to the closure operation. Provision has accordingly been made in accordance with the invention for means which are capable of ensuring limitation of wear of the seal. To this end and in accordance with a preferred arrangement, the travel of the annular support unit 2 is limited by a washer 21 which comes into abutting contact with the retaining ring 13. In the event of errors of operation or after a long period of operation, wear of the seal is limited to the value of the clearance which remains between said washer 21 and the retaining ring 13 when the jack is under pressure during a normal stage of operation. In this case, however, the operation of the closure system is substantially modified by reason of the fact that pressurization of the jack no longer makes it possible to obtain immediate leak-tightness between the noxious fluid and the external atmosphere at the moment of withdrawal of the driving motor. The operation is in fact as follows: when the rotor has stopped, a fluid is delivered under pressure into the jack and has the effect of displacing the annular support unit 2 so as to bring this latter into abutting contact with the retaining ring 13 by means of the washer 21. As a result of accidental wear, the annular seal 11 comes lightly into contact with the knife-edges 12 of the rotor 7 without permitting sufficient leak tightness. On the other hand, the downward displacement of the rotor at the time of disassembly accordingly puts the knife-edges of this latter automatically into contact with the annular seal 11 and, as in normal operation, initiates the displacement of the annular support unit 2 and of the retaining ring 13. The remainder of the operation is identical with that described earlier.

In the event of major damage which has the result of preventing operation of the first control means, the device in accordance with the invention is employed as follows: at the time of withdrawal of the driving motor, the rotor carries out a downward displacement as already mentioned and the knife-edges 12 of this latter come into contact with the seal 11. The rotor therefore thrusts back the annular support unit 2 and the retaining ring 13 before finally resting on the frame at 19. The driving motor releases the resilient washer 16 by means of the ring 17 which is applied against the casing 10 of the driving motor. The resilient washer 16 thus ensures that an effort is exerted on the annular seal 11 on the one hand by the knife-edges of the rotor and on the other hand by the knife-edges of the support unit and also ensures automatic locking of the closure system. Unlocking is carried out by replacing the driving motor in position. It is thus apparent that the action of the second control means is superposed on the action of the first control means while ensuring a remarkably high degree of operational safety in all cases.

What we claim is:

1. A sealing device with closure system for a rotary machine having a vertical axis of rotation, comprising a driving mechanism, disconnectable coupling means and a rotor in which a noxious fluid is conveyed, an annular seal in a plane at right angles to said axis of rotation and clamped between stationary knife-edges on an annular support unit moving along said axis, two closure control means operated successively, the first of said control means effecting the displacement of said annular support unit between an inactive position and an active position and conversely actuated externally of the machine and the second of said control means exerting a complementary effort on said annular support unit upon withdrawal of said driving mechanism, said second control means being a resilient member applied on one side against a ring retaining said annular support unit and applied on the other side against a ring rigidly fixed to said driving mechanism in an inactive position and against a stop integral with said rotor in an active position.

2. A device according to claim 1, wherein said first closure control means is an annular jack.

3. A device according to claim 2, said annular jack having at least one stationary wall and one movable wall joined together by semi-toric diaphragms connected tangentially to said walls.

4. A device according to claim 3, wherein said diaphragms are metallic diaphragms.

5. A device according to claim 4, wherein said metallic diaphragms are welded to said walls.

6. A device according to claim 1, wherein said resilient member is a washer.

7. A device according to claim 1, wherein a stop washer rigidly fixed to said annular support unit cooperates with said retaining ring to limit the wear of the seal.

8. A device according to claim 1, including a resilient washer for returning said annular support unit and for counteracting said two control means.

* * * * *